US006250952B1

(12) United States Patent
Shiga et al.

(10) Patent No.: US 6,250,952 B1
(45) Date of Patent: Jun. 26, 2001

(54) AIR BAG CONNECTOR

(75) Inventors: Katsumi Shiga, Chiba; Hiroshi Kitamura, Kanagawa; Toshio Shinohara, Kanagawa; Hidehisa Yamagami, Kanagawa, all of (JP)

(73) Assignee: The Whitaker Corporation, Wilimington, DE (US)

( * ) Notice: Subject to any disclaimer, the term of this patent is extended or adjusted under 35 U.S.C. 154(b) by 0 days.

(21) Appl. No.: 09/485,306

(22) PCT Filed: Aug. 7, 1998

(86) PCT No.: PCT/US98/16508

§ 371 Date: Feb. 4, 2000

§ 102(e) Date: Feb. 4, 2000

(87) PCT Pub. No.: WO99/08062

PCT Pub. Date: Feb. 18, 1999

(30) Foreign Application Priority Data

Aug. 8, 1997 (JP) ..... 9-227246

(51) Int. Cl.[7] ..... H01R 13/58
(52) U.S. Cl. ..... 439/466
(58) Field of Search ..... 439/352, 357, 439/350, 351, 488–499, 15, 135, 599, 746, 741, 733

(56) References Cited

U.S. PATENT DOCUMENTS 4,306,499 12/1981 Holmes ..... 102/202.4
5,200,574 4/1993 Cunningham et al. ..... 102/530
5,241,910 9/1993 Cunningham et al. ..... 102/530
5,454,587 10/1995 Halford et al. ..... 280/728.1
5,637,010 * 6/1997 Jost et al. ..... 439/352
5,932,832 8/1999 Hansen et al. ..... 102/202.4

FOREIGN PATENT DOCUMENTS 5-105027 4/1993 (JP) ..... B60R/21/32

* cited by examiner

*Primary Examiner*—Neil Abrams
*Assistant Examiner*—J. F. Duverne

(57) ABSTRACT

The igniter connector comprises an insulating housing having a bead-receiving cavity open at one end, a partition in a center of a bottom wall of the cavity, a ferrite bead disposed in the bead-receiving cavity, and holes in the bottom wall of the bead-receiving cavity for insertion of pin terminals, the ferrite bead that is inserted in the bead-receiving cavity and secured in the insulating housing with the ferrite bead having a central opening through which the partition is passed when the ferrite bead is inserted in the bead-receiving cavity, a pair of electrical contacts having receptacle sections for electrical connection with the pin terminals are arranged in contact-receiving cavities disposed between the partition and the ferrite bead inserted in the bead-receiving cavity and wire-connecting sections for connection to electrical wires, and a cover member enclosing the bead-receiving cavity of the insulating housing is latched to the housing and has posts coaxially aligning the receptacle sections of the electrical contacts with the holes for the pin terminals. The cover member is equipped with a pressure device that exerts pressure on the ferrite bead holding it down against the bottom of the bead-receiving cavity.

9 Claims, 8 Drawing Sheets

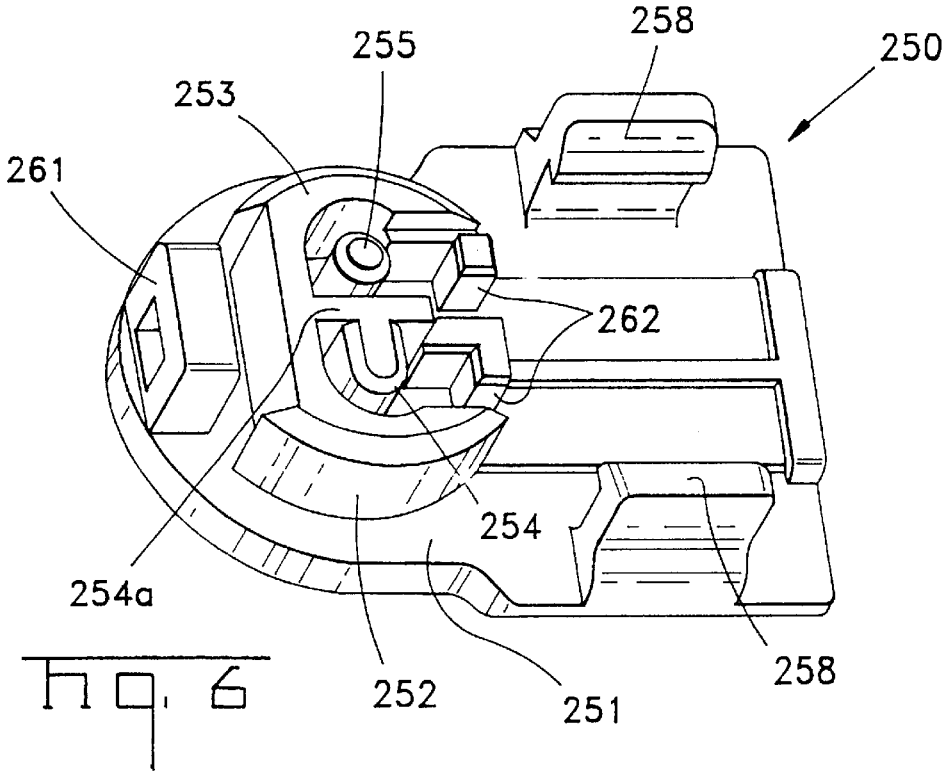
Fig. 6
Fig. 7
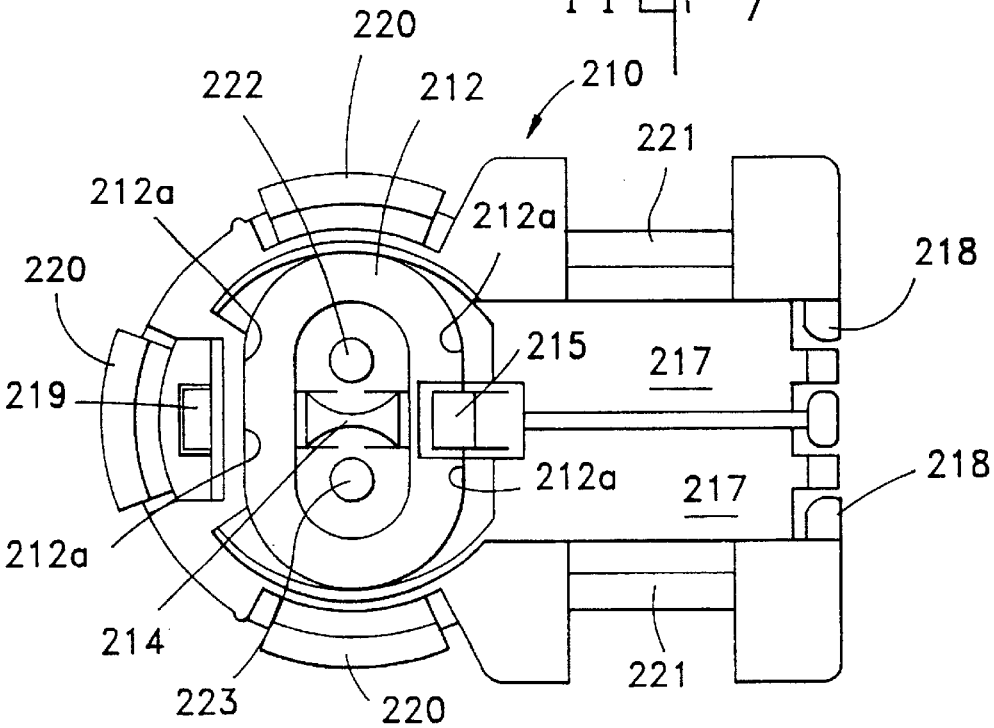

AIR BAG CONNECTOR

The present invention relates to igniter connectors used in automotive air bad equipment.

Automotive collision protection systems, comprising air bags are known. Is such systems, air bags mounted in a steering wheel and other vehicle locations are instantly inflated by gas produced by a gas generator, which is activated when an impact is detected by a collision detector, thus protecting the driver and passengers of the vehicle. The gas generated by the respective gas generator, that is activated by an electric signal applied to an ignition tube from the collision detector, and the collision detector and the ignition tube are connected by means of the ignition connector.

Document DE 296 04 891 discloses an electrical connector of the general type used with air bags, which is comprised of an insulting housing and electrical contacts mounted in the housing and a two part cover member on the wire termination portion of the contacts and an outer hinged cover. However, this connector does not appear to have sufficient room for a ferrite bead surrounding the contacts. Ferrite beads are often used to prevent extraneous signals.

U.S. Pat. No. 5,616,045 discloses a squib connector of this type in which a ferrite bead surrounds the wire termination portions of two contacts mounted in a housing and wires extending into the housing. The ferrite bead does not surround the receptacle sections of these contacts.

Another example of such a connector is shown in FIG. 10 and is disclosed in Japanese Patent Publication No. 5-105027.

Ignition tube connector 100 as shown in FIG. 10 comprises an insulating housing 110, a ferrite bead 120 placed in the insulating housing 110 for protection against RFI and EMI, and two electrical contacts 130, 132 arranged in openings 121, 122 in the ferrite bead 120. Electrical wires 140 connected to wire-connecting sections 131, 133 of the electrical contacts 130, 132 link them to a collision detector (not shown). The insulating housing 110, ferrite bead 120, electrical contacts 130, 132 and electrical wires 140 are joined in an integral body by means of insert molding.

In addition, ignition tube connector 100 is mounted on a base 153 of a gas generator (not shown) and pin terminal 151 of an igniter 150 extend through holes of the insulating housing 110 of the igniter connector 100 and are electrically connected to the electrical contacts 130, 132 in a plug-and-socket manner. Igniter member 152 causing the ignition of the material producing gas in the generator is located in igniter 150.

However, the position of the electrical contacts 130, 132 in the insulating housing 110 of the igniter connector 100 is determined by passing the connecting sections 131, 133 of the electrical contacts 130, 132 through the openings 121, 122 of the ferrite bead 120. Ferrite bead 120 is secured in the insulating housing 110 by means of insert molding.

However, in some cases, in the process of insert molding of the igniter connector 100, the position of the ferrite bead 120 relative to the insulating housing 110 can be shifted by the ejection pressure or the position of the electrical contacts 130, 132 in the openings 121, 122 of the ferrite bead can be distorted, thus rendering the position of the electrical contacts 130, 132 relative to the insulating housing 110 to be misaligned. As a result, in some cases, it becomes impossible for pin terminals 151 of the igniter 150 to be connected with the electrical contacts 130, 132.

Therefore, the purpose of the present invention is to provide an igniter connector that makes it possible to precisely position electrical contacts relative to the insulating housing, thus providing for accurate electrical connection of igniter pin terminals and the electrical contacts.

The igniter connector according to the present invention comprises an insulating housing having a bead-receiving cavity open at one end, a partition in a center of a bottom wall of the cavity, a ferrite bead disposed in the bead-receiving cavity, and holes in the bottom wall of the bead-receiving cavity for insertion of pin terminals, the ferrite bead that is inserted in the bead-receiving cavity and secured in the insulating housing with the ferrite bead having a central opening through which the partition is passed when the ferrite bead is inserted in the bead-receiving cavity, a pair of electrical contacts having receptacle sections for electrical connection with the pin terminals are arranged in contact-receiving cavities disposed between the partition and the ferrite bead inserted in the bead-receiving cavity and wire-connecting sections for connection to electrical wires, and a cover member enclosing the bead-receiving cavity of the insulating housing is latched to the housing and has posts coaxially aligning the receptacle sections of the electrical contacts with the holes for the pin terminals.

The cover member is equipped with a pressure device that exerts pressure on the ferrite bead holding it down against the bottom of the bead-receiving cavity.

The electrical contacts have semi-cylindrical guiding sections between the contact sections and the wire-connecting sections that are engaged by posts on the cover member when the cover member is mounted on the insulating housing thereby aligning the contact sections with pin-insertion holes in a bottom wall of the bead-receiving cavity.

The ferrite bead is prevented from rocking in the bead-receiving cavity of the insulating housing by lugs on side walls of the bead-receiving cavity that engage with outside walls of ferrite bead.

The ferrite bead is also prevented from rocking in the bead-receiving cavity by providing lugs located between guiding sections and wire-connecting sections of the electrical contacts that are engaged with retainer lugs on the cover member, thereby restricting the movement of the electrical contacts in the direction of pulling forces on the electrical wires connected to the wire-connecting sections of the electrical contacts.

An electrical connector comprises an insulating housing having a bead-receiving cavity in which a ferrite bead is received, electrical contacts mounted in the housing and having contact sections disposed along the bead-receiving cavity, and a cover member on the housing, wherein posts are provided by the cover member engaging the electrical contacts and aligning the contact sections with pin-insertion holes in a bottom wall of the bead-receiving cavity.

Embodiments of the present invention will now be described by way of example with reference to the accompanying drawings in which:

FIG. 3 is a perspective view of a cover member of the igniter connector shown in FIG. 1.

FIG. 6 is a perspective view of a cover member of the igniter connector shown in FIG. 5.

Figure 1:
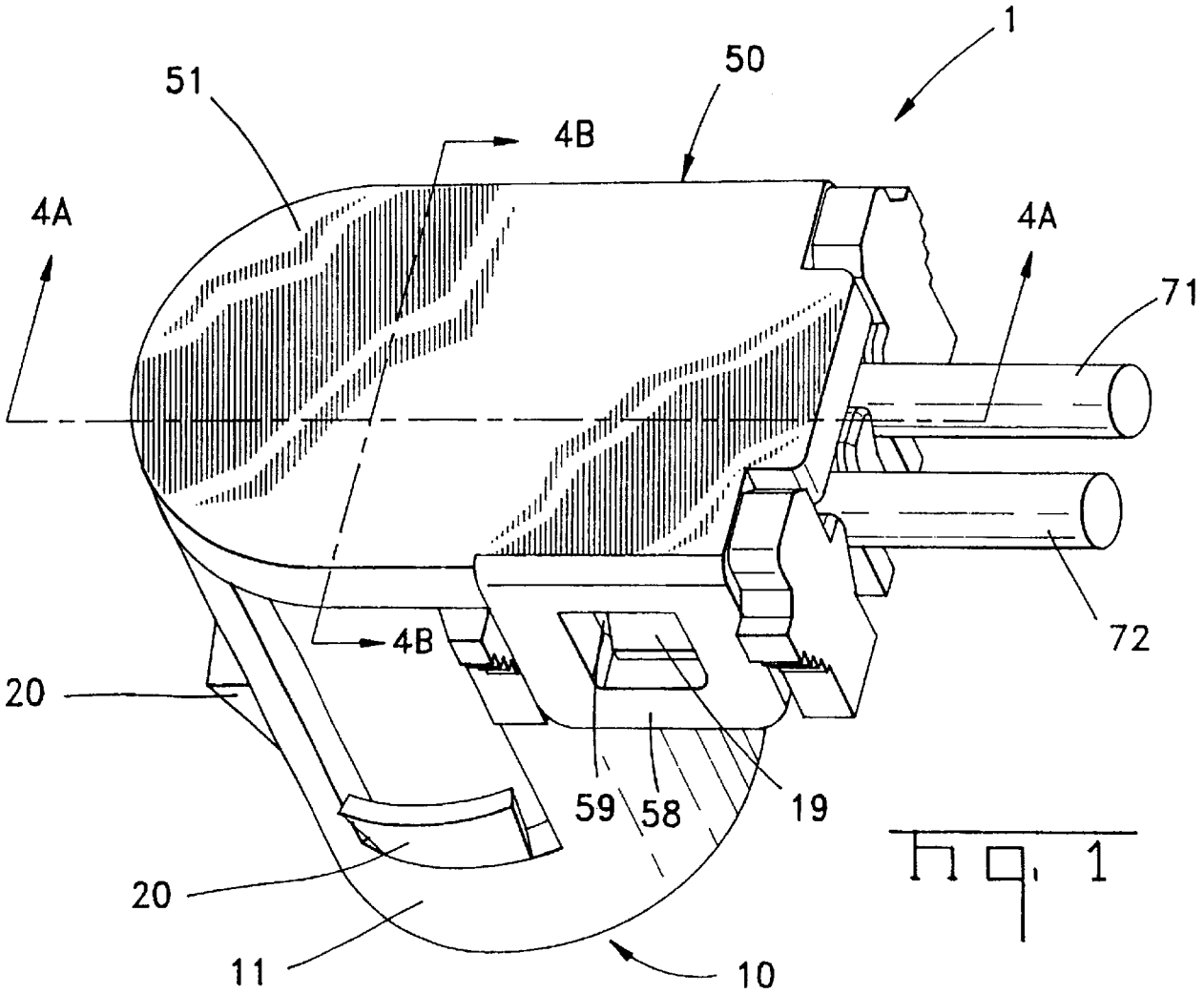
FIG. 1 is a perspective view of an igniter connector according the present invention.
Figure 2:
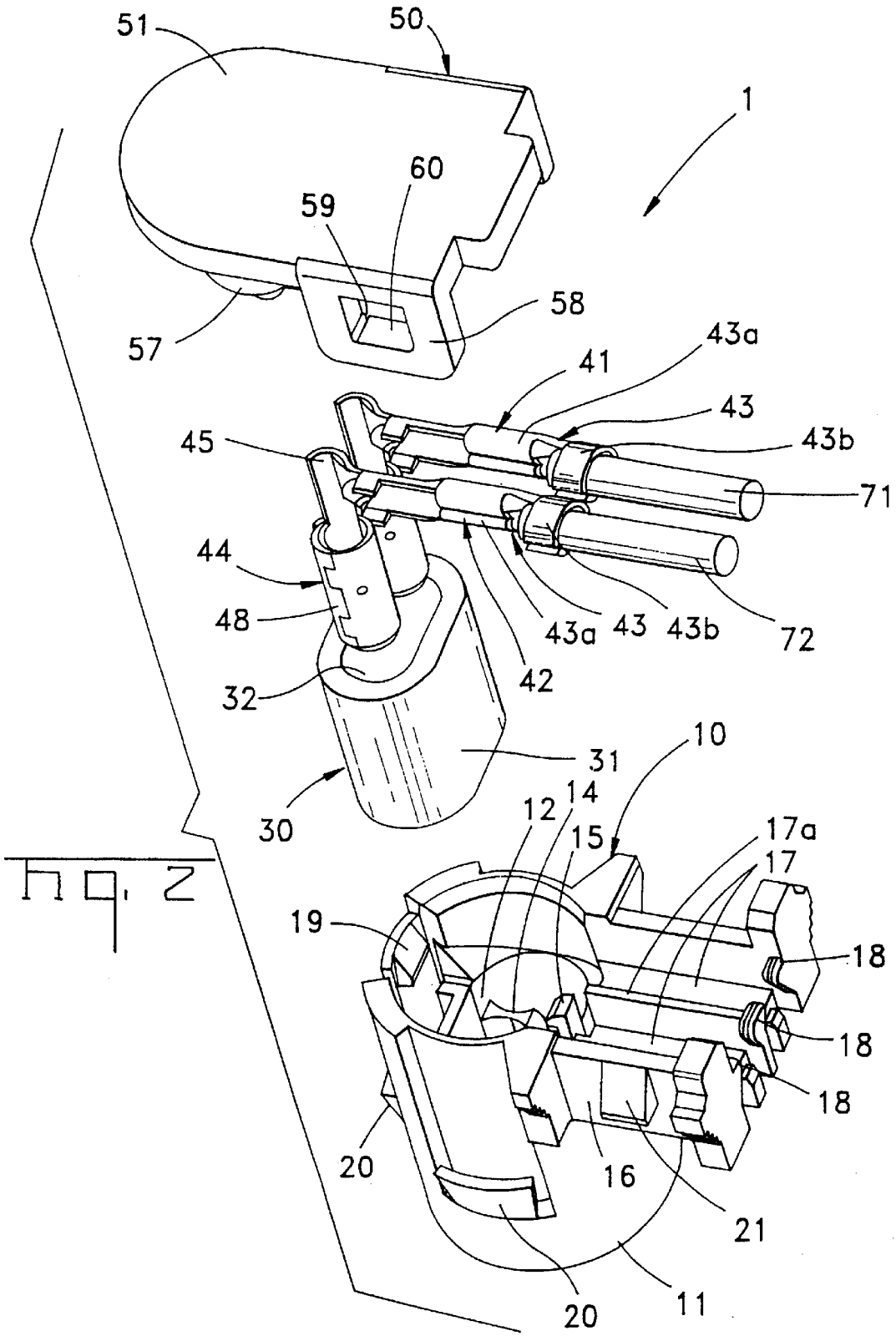
FIG. 2 is an exploded perspective view of the igniter connector shown in FIG. 1.
Figure 7:
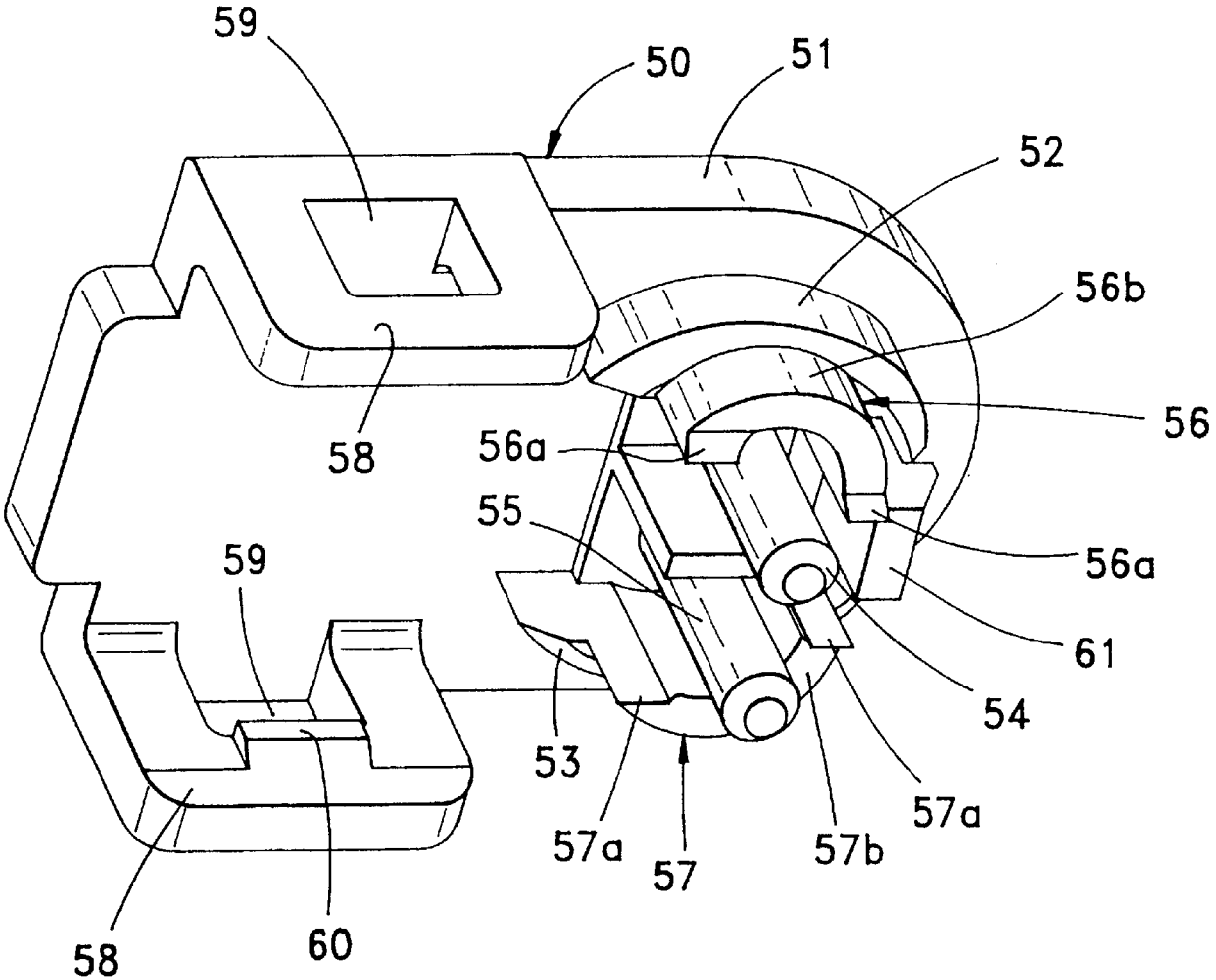
FIG. 7 is a plan view of an insulating housing of the igniter connector shown in FIG. 5.

As shown in FIGS. 1–4, igniter connector 1 comprises an insulating housing 10, a ferrite bead 30 contained in a ferrite bead-receiving cavity 12 of the insulating housing 10, a pair of electrical contacts 41, 42 located in contact-receiving cavities 13*a*, 13*b* (FIG. 4B) formed by a partition 14 in the insulating housing 10 and the ferrite bead 30 contained in the ferrite bead-receiving cavity 12, and a cover member 50 covering the ferrite bead-receiving cavity 12 of the insulating housing 10.

The insulating housing 10 is made of a suitable plastic material as an integral unit including a housing main body 11 having a cylindrical shape and an extension 16 extending from an outside surface at one side of the housing main body 11. Inside the housing main body 11, a ferrite bead-receiving cavity 12 is located, which is open at one end and is of a smaller diameter. Approximately at the center of the bottom of the bead-receiving cavity 12, a partition 14 is located extending in the direction of the open end. On both sides of the partition 14, pin terminal-insertion holes 22, 23 extend through a bottom wall of main body 11 along an axis of the bead-receiving cavity 12, they are provided for the insertion of igniter pin terminals (not shown). Edges of the terminal-insertion holes 22, 23 are chamfered 22*a*, 23*a* to facilitate the insertion of pin terminals therethrough.

On one side in the direction of the short axis of the bead-receiving cavity 12 (the left-to-right direction in FIG. 4A), a ferrite bead-retaining latch 15 is provided to latch onto an upper end of the ferrite bead 30. On an outside wall of the housing main body 11 at an opposite end of the short axis of the bead-receiving cavity 12, a cover-retaining latch 19 is located, the purpose of which as described below in more detail is to engage a retaining lug 61 provided on the cover member 50. At both sides of the extension 16, a pair of cover-latching lugs 21 are provided which, together with latches 58 provided on the cover member 50, latch the cover member 50 in place on main body 11. In addition, on the outside wall of the housing main body 11, three resilient lances 20 extending outward are provided, the purpose of which is to latch the connector in a holder (not shown). The extension 16 has a central divider 17*a* separating grooves 17 for receiving wire-connecting sections 43 of the electrical contacts 41, 42. The grooves 17 are linked to the bead-receiving cavity 12, and they have wire-retaining members 18 retaining electric wires 71, 72 connected to the wire-connecting sections 43 within grooves 17.

The external configuration of the ferrite bead 30 is such that it corresponds to the inside configuration of the bead-receiving cavity 12 of the insulating housing 10. The ferrite bead 30 is made in the form of a tube 31 of a generally oval cross section with a central opening 32. The ferrite bead 30 is made from a suitable ferrite material by sintering. The ferrite bead 30 is inserted in the bead-receiving cavity 12 of the insulating housing 10 so that the partition 14 is inserted in the central opening 32 and the upper end of the ferrite bead 30 is latched in the cavity 12 by means of the retaining latch 15. Because of such a configuration, two contact receiving cavities 13*a*, 13*b* are formed between the partition 14 and ferrite bead 30.

Since the electrical contacts 41, 42 are identical, an explanation concerning only the electrical contact 41 will be provided.

The electrical contact 41 includes a receptacle section 44 intended to form a plug-and-socket connection with the igniter pin terminal, and a wire-connecting section 43 connected to electrical wire 71 of the collision detector. Receptacle section 44 is arranged in the contact-receiving cavity 13*a*. The receptacle section 44 includes a contact section 47 having a number of spring-loaded contact members 46 that electrically connect with the igniter pin terminal, a guiding section 45, the purpose of which is to guide alignment posts 54 of the cover member 50 (detailed explanations are provided below) and a sleeve 48, made as a separate component, surrounding the contact section 47. The wire-connecting section 43 includes a wire barrel 43*a* for crimping onto a core of the electrical wire 71 and an insulation barrel 43*b* for crimping onto an insulation sleeve of the electrical wire 71.

Receptacle sections 44 of the contacts 41, 42 are inserted in the contact-receiving cavities 13*a*, 13*b*. The partition 14 insulates the electrical contacts 41, 42 from each other, and the ferrite bead 30 provides protection from RFI and EMI. The wire-connecting sections 43 are placed in the wire-receiving grooves 17 of the extension 16, and the electrical wires 71, 72 connected to the wire-connecting sections 43 are retained therein by means of the wire-retaining members 18.

The cover member 50 is molded from a suitable plastic, and as shown in FIG. 3, includes cover main body 51; two arcuate alignment projections 52, 53 that extend downwardly from a bottom surface of the cover main body 51 (the lower surface of the cover member in FIG. 4B) that engage with inside walls of the bead-receiving cavity 12 of the insulating housing 10, thus aligning the cover member 50 relative to the insulating housing 10; a resilient latch member 61 that extends downwardly from the bottom surface of the cover main body 51 and engages with the cover-retaining latch 19 of the insulating housing 10, thus latching the cover member 50 on the housing; and two latch members 58 extending downward from both sides of the cover main body 51 that engage with two cover latching lugs 21 on the insulating housing 10. Latches 58 have apertures 59 at the lower side of which inwardly-facing detents 60 are provided. Between the alignment projections 52, 53, alignment posts 54, 55 are located, the purpose of which is to position receptacle sections 44 of the electrical contacts 41, 42 co-axially with the holes 22, 23 for the insertion of pin terminals therethrough for electrical connection with the receptacle sections 44. When the cover member 50 is latched on the insulating housing 10 covering the bead-receiving cavity 12, the alignment posts 54, 55 extend through the guiding sections 45 into the receptacle sections 44 of the electrical contacts 41, 42, thereby aligning the receptacle sections 44 co-axially with the holes 22, 23 for the insertion of the pin terminals therethrough. Therefore, the igniter pin terminals are inserted through the holes 22, 23 and form precise and appropriate pin-and-socket electrical connection with the receptacle sections 44 of the electrical contacts 41, 42.

Figure 4A:
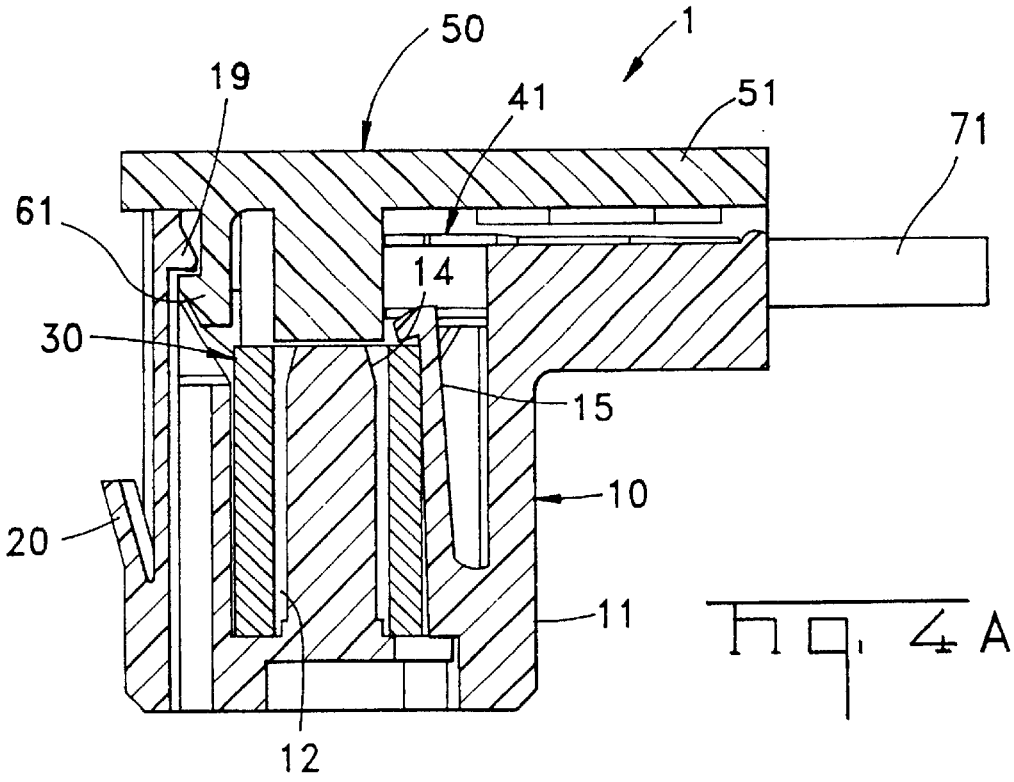
FIGS. 4A and 4B are cross-sectional views of the igniter connector shown in FIG. 1 taken along line 4A—4A and 4B—4B respectively in FIG. 1.
Figure 4B:
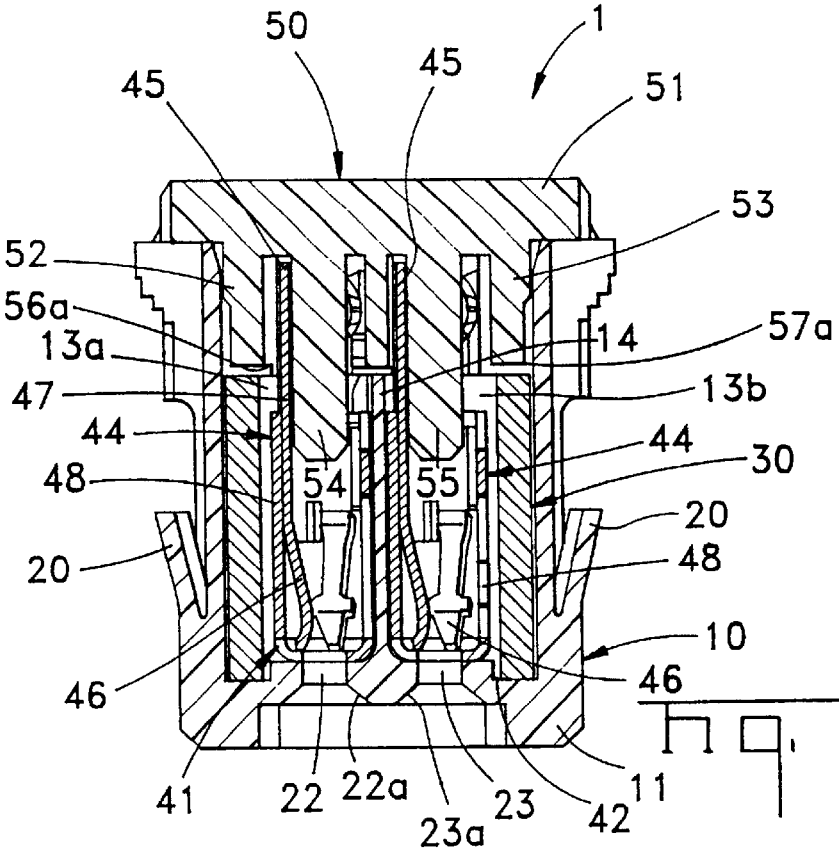
Figure 5:
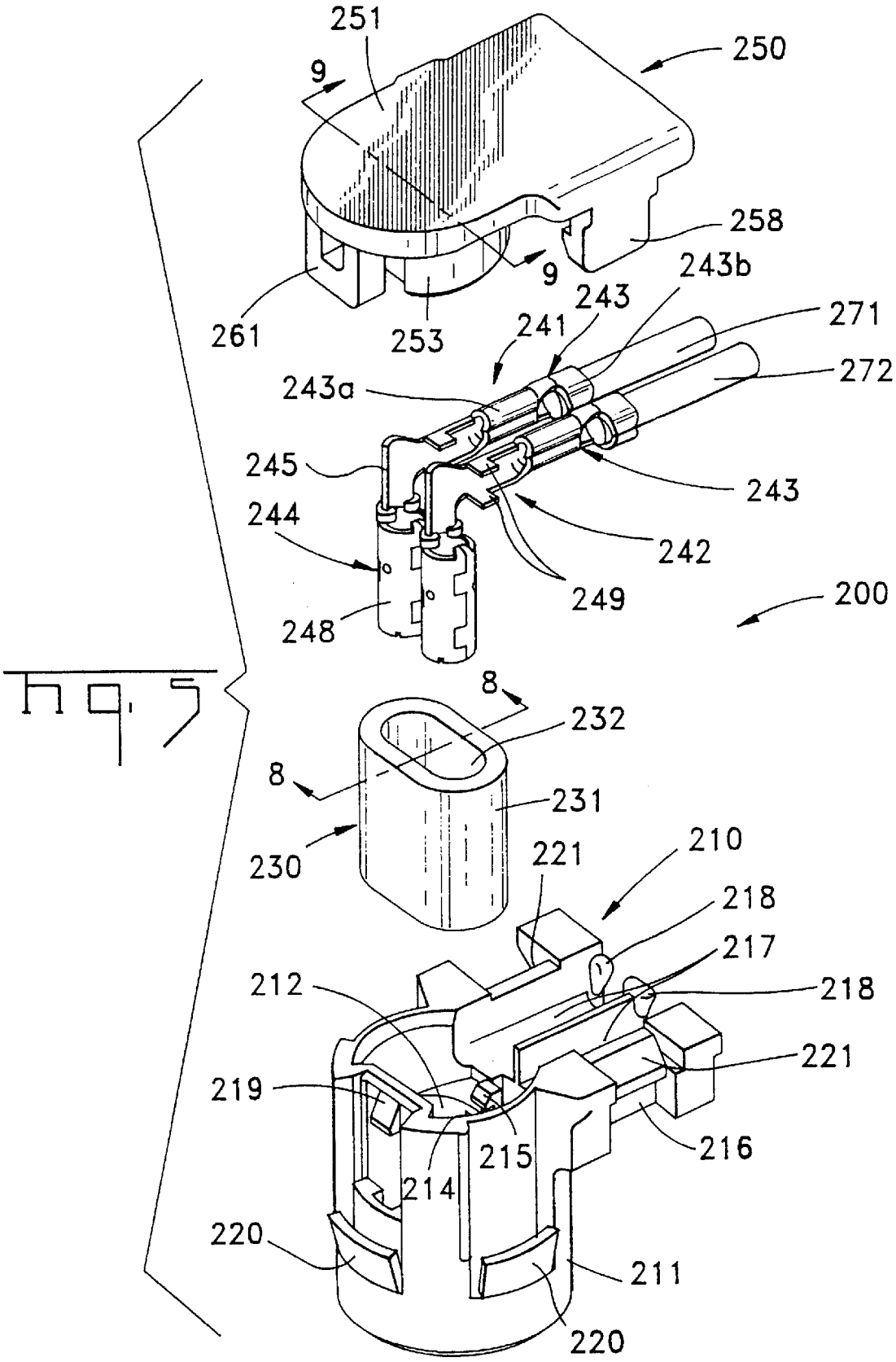
FIG. 5 is an exploded perspective view of an alternative embodiment of the present invention.
Figure 8:
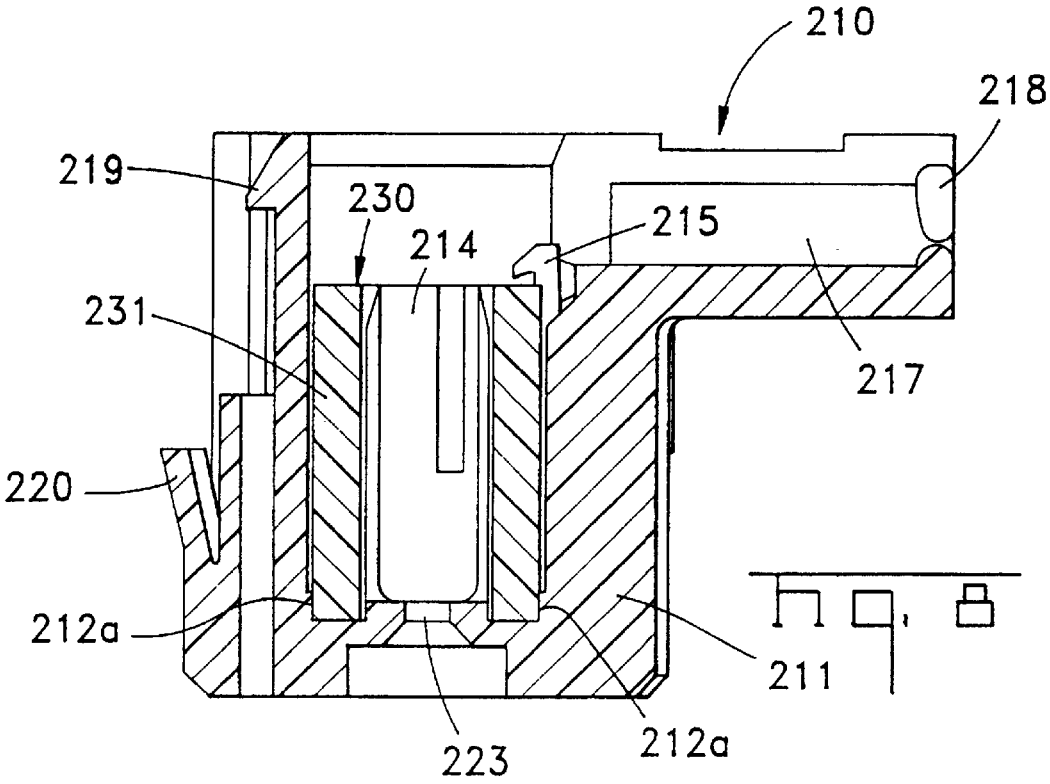
FIG. 8 is a cross-sectional view taken along line 8—8 in FIG. 5 of the igniter connector shown in FIG. 5 with the ferrite bead inserted in the insulating housing.

As shown in FIGS. 3 and 4B, the alignment projections 52, 53 have pressure lugs 56, 57 extending downwards from the alignment projections that exert pressure on the ferrite bead 30 pressing it against the bottom of the bead-receiving cavity 12. The pressure lugs 56, 57 have C-shaped bases 56*b*, 57*b* protruding from the alignment projections 52, 53, each having pressure tips 56*a*, 57*a* that are located at the ends of the bases 56*b*, 57*b* and have surfaces slanted outward. As shown in FIG. 4B, when the cover member 50 is latched on the insulating housing 10, the pressure tips 56*a*, 57*a* of the pressure lugs 56, 57 exert pressure on the upper end of the ferrite bead 30 thereby pressing it against the bottom of the bead-receiving cavity 12, thus reliably retaining the ferrite bead 30 in the ferrite-bead-receiving cavity 12.

Igniter connector 200 shown in FIGS. 5 through 9 as an alternative embodiment of the present invention comprises an insulating housing 210, a ferrite bead 230 inserted in the bead-receiving cavity 212, two electrical contacts 241, 242 arranged in contact-receiving cavities 213*a*, 213*b* separated by a partition 214 in the insulating housing 210, the ferrite bead 230 is placed in the bead-receiving cavity 212, and a cover member 250 closes the bead-receiving cavity 212 of the insulating housing 210.

The insulating housing 210 includes a cylindrical housing main body 211 and an extension 216 extending from one side of the housing main body both of which are molded from a suitable plastic material as an integral unit. Inside the housing main body 211, cavity 212 that is open at one end is formed to receive an oval ferrite bead 230 and at the bottom of which partition 214 extends to the opening. On both sides of the partition 214, terminal-insertion holes 222, 223 extend through a bottom wall and are in communication with the bead-receiving cavity 212, holes 222, 223 being provided for the insertion of igniter pin terminals (not shown). On one side in the direction of a short axis of the bead-receiving cavity 212 (the left-to-right direction in FIG. 8), a retaining latch 215 is provided to latch the ferrite bead 230 in cavity 212. At the lower parts of the walls at the opposite ends of the short axis of the bead-receiving cavity 212, several lugs 212*a* are provided that engage the ferrite bead 230 to prevent the ferrite bead 230 from rocking, which is different from the igniter connector 1 depicted in FIGS. 1 through 4. Therefore, even if the dimensions of the outer diameter of the ferrite bead 230 are slightly distorted during the sintering, it still can be secured inside the bead-receiving cavity 212 without rocking. On the outer wall at the side opposite to the one at which the ferrite bead latch 215 is located, a cover-latching detent 219 is located that engages with latch 261 provided on the cover member 250. At both sides of the extension 216, a pair of cover-latching lugs 221 are provided that are wider than the cover-latching lugs 21 of the igniter connector 1 depicted in FIGS. 1 through 4, which, together with latches 258 provided on the cover member 250, latch the cover member 250 in place while providing a stronger retention of the cover member 250 on the insulating housing 210. In addition, on the outside wall of the housing main body 211, three resilient lances 220 extending outward are provided, the purpose of which is to secure the connector in the holder (not shown). The extension 216 has two grooves 217 intended for the reception of the wire-connecting sections 243 of the electrical contacts 241, 242. The grooves 217 are linked to the bead-receiving cavity 212, and they have retaining lugs 218 at the exit ends retaining the electrical wires 271, 272 connected to the wire-connecting sections 243 when the wire-connecting sections 243 with connected wires 271, 272 are arranged in the grooves 217.

Figure 9:
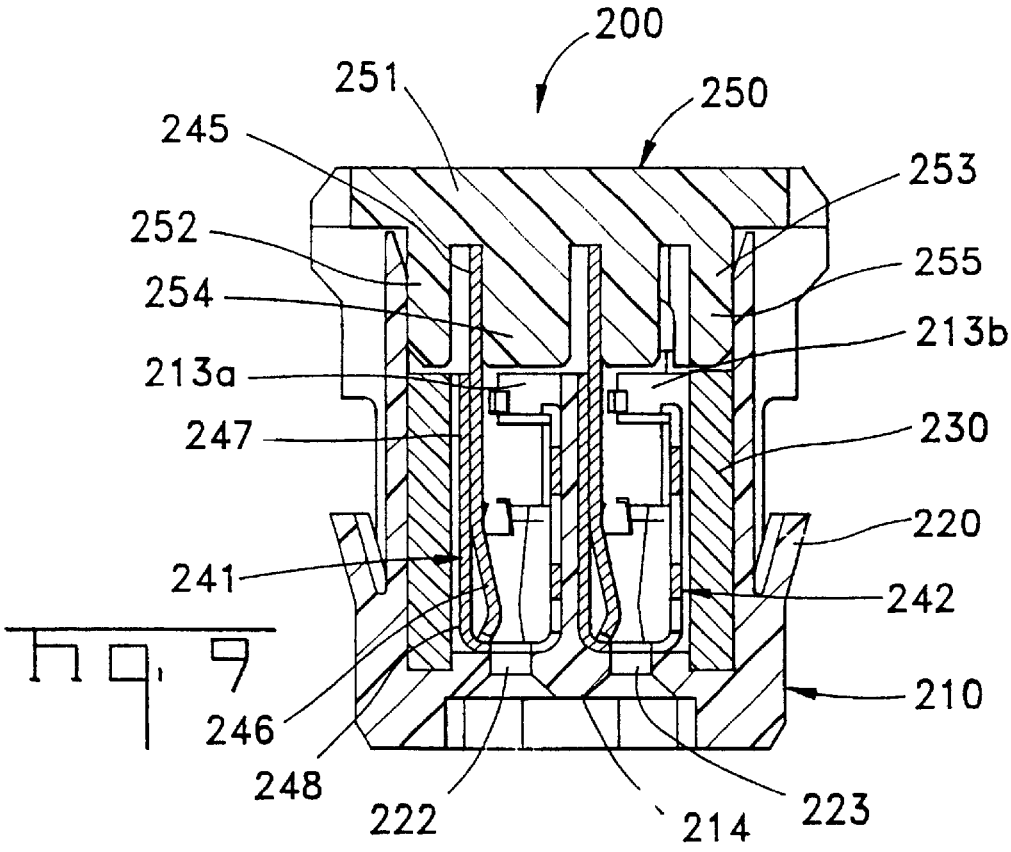
FIG. 9 is a cross-sectional view taken along line 9—9 of the igniter connector shown in FIG. 5.
Figure 10:
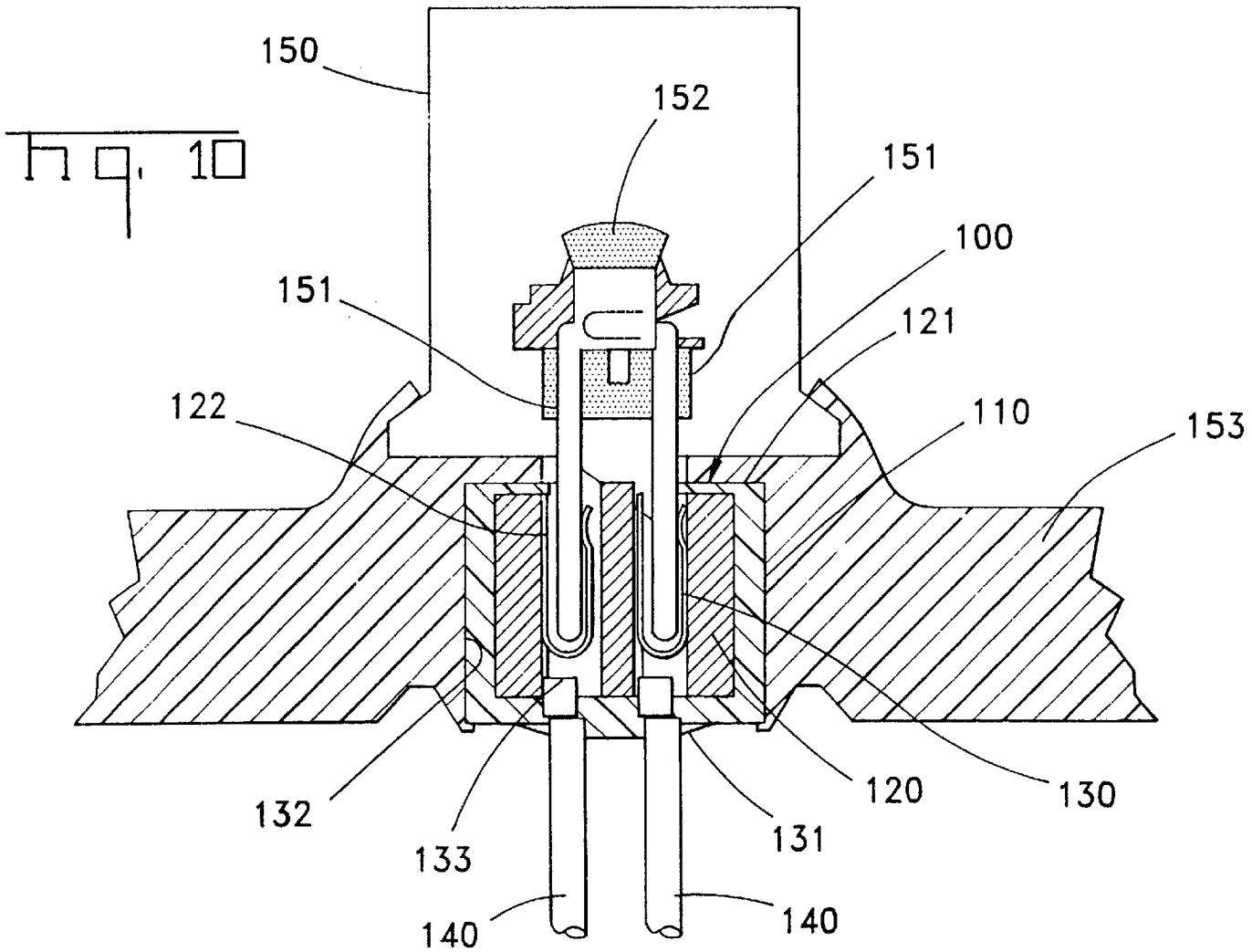
FIG. 10 is a cross-sectional view of a conventional igniter connector.

The ferrite bead 230, the outside configuration of which conforms to the inside configuration of the bead-receiving cavity 212 is made in the form of an oval tubing 231 having a central passage 232. The ferrite bead 230 is fabricated from a ferrite material by sintering. When the ferrite bead is inserted in the bead-receiving cavity 212, the partition 214 is disposed in the central opening 232 and an upper edge of the ferrite bead 230 is retained in the cavity 212 by the latch 215. Therefore, contact-receiving cavities 213*a*, 213*b* are located between the partition 214 and the ferrite bead 230 as shown in FIG. 9.

Since the contacts 241, 242 are of an identical configuration, an explanation concerning the contact 241 only is provided.

The electrical contact 241 includes a receptacle section 244 intended to form a plug-and-socket connection with the igniter pin terminal, a guiding section 245 in the form of a half-cylindrical tube extends upward from the receptacle section 244, and a wire-connecting section 243 connected to electrical wire 271 is perpendicular to the guiding section 245. Receptacle section 244 comprises a contact section 247 having a spring-loaded contact member 246 that electrically connects with the igniter pin terminal, and a sleeve 248 surrounding the contact section 247. The wire-connecting section 243 includes a wire barrel 243*a* crimped onto the core of the electrical wire 271 and an insulation barrel 243*b* crimped onto the insulation sleeve of the electrical wire 271. A pair of lugs 249 are located between the guiding section 245 and the wire-connecting section 243. The purpose of the lugs 249 is to prevent the electrical contact 241 from being pulled out by a force applied to the electrical wire by engagement with projections 262 provided on the cover member 250.

Receptacle sections 244 of the contacts 241, 242 are inserted in the contact-receiving cavities 213*a*, 213*b* of the insulating housing 210. At this time, the partition 214 insulates the electrical contacts 241, 242 from each other, and the ferrite bead 230 provides protection from RFI and EMI. The wire-connecting sections 243 are placed in the grooves 217 and the electrical wires 271, 272 connected to the wire-connecting sections 243 are retained therein by means of the wire-retaining lugs 218.

The cover member 250 is molded from a suitable plastic, and it includes a cover main body 251; two arcuate alignment projections 252, 253 that extend outwardly from a bottom surface of the main body 251 and engage with inside walls of the bead-receiving cavity 212 of the insulating housing 210, thereby aligning the cover member 250 relative to the insulating housing 210; a resilient latch 261 extends outwardly from the bottom surface of the body 251 and engages with cover-latching lug 219 on the insulating housing 210; and latches 258 extending downward from both sides of the cover main body 251 that engage with cover latching lugs 221 on the insulating housing 210. Between the alignment projections 252, 253, a semi-cylindrical post 254 extending from a partition 254*a* and a cylindrical post 255 extend outwardly from the bottom surface of the cover main body 251. The space between an inner part-cylindrical surface of the alignment projection 252 and the semi-cylindrical post 254 and the space between an inner part-cylindrical surface of the alignment projection 253 and the cylindrical post 255 are provided for being disposed in the guiding sections 245 of the electrical contacts 241, 242 to align the receptacle sections 244 with the pin terminal holes 222, 223 when the cover member 250 is latched on the insulating housing 210. Therefore, the spaces constitute an alignment means for the receptacle sections 244. The purpose of the posts 254, 255 is to assure an accurate alignment of receptacle sections 244 of the electrical contacts 241, 242 with the holes 222, 223 so that the igniter pins inserted through the holes 222, 223 can readily connect with receptacle sections 244. Therefore, the igniter pins inserted through the igniter pin holes 222, 223 form an accurate pin-and-socket connection with the receptacle sections 244 of the electrical contacts 241, 242. Posts 254, 255 extend from the bottom surface of the cover main body, but they extend downward to a lesser degree than the posts 54, 55 of the igniter connector 1 shown in FIGS. 1 through 4, and their tips are practically at the same level as the alignment projections 252, 253. Therefore, when the cover member 250 is being affixed to the insulating housing 210, the posts 254, 255 do not extend within the receptacle sections 244 of the electrical connectors 241, 242, thus simplifying placing the cover member 250 on the housing 210.

On the bottom surface of the cover main body 251, two projections 262 are provided that limit movement of the electrical contacts 241, 242 by engaging with the lugs 249 on the electrical contacts 241, 242 when the cover member 250 is latched on the insulating housing 210. Therefore, after the insulating housing 210 is closed by the cover member 250, the movement of the electrical contacts 241, 242 is limited by the projections 262 even if the electrical wires are pulled, thereby preventing structurally weak guiding sections 245 of the electrical contacts 241 from breaking or becoming misaligned.

The igniter connector of the present invention includes an insulating housing provided with a bead-receiving cavity in which a ferrite bead is received, a bottom wall of the bead-receiving cavity has pin-insertion holes through which pin terminals are inserted, electrical contacts are mounted in the housing and have contact sections disposed in contact-receiving cavities extending along the bead-receiving cavity, a cover member is latchably mounted on the housing and includes posts extending into the contact sections of the electrical contacts thereby aligning the contact sections with the pin-insertion holes so that the pin terminals can readily connect with the contact sections.

A partition is located in the bead-receiving cavity insulating the contact sections from each other.

The cover member has pressure members intended to press the ferrite bead against the bottom of the bead-receiving cavity. Therefore, when the cover member is secured on the insulating housing, the ferrite bead becomes positively retained in the bead-receiving cavity.

When the cover member is placed on the housing, the posts are engaged with guiding sections of the electrical contacts, thus aligning the contact sections of the electrical contacts with the pin-insertion holes. Therefore, the igniter pin terminals passing through the pin-insertion holes form precise pin-and-socket connection with the contact sections of the electrical contacts.

Lugs are provided on the side walls of the bead-receiving cavity that, by engaging with outer walls of the ferrite bead, positively prevent it from being rocked inside the cavity. This makes it possible to compensate for small variations in the external dimensions of the ferrite bead appearing in the process of sintering thereof.

Lugs are provided between the guiding sections and the wire-connecting sections of the electrical contacts which, together with projections provided on the cover member limit the movement of the electrical contacts if the electrical wires connected to the contacts are pulled. Therefore, when the insulating housing is closed by the cover, the lugs prevent the structurally weak guiding sections from damage caused by pulling forces on the electrical wires by limiting the movement of the electrical contacts.

What is claimed is:

1. An electrical connector comprising an, insulating housing (10, 210) having a bead-receiving cavity (12, 212) in which a ferrite bead (30, 230) is received, electrical contacts (41, 42 241, 242) mounted in the housing and having contact sections (44, 244) disposed along the bead-receiving cavity, and a cover member (50, 250) on the housing, characterized in that posts (54, 55, 254, 255) are provided by the cover member engaging the electrical contacts and aligning the contact sections with pin-insertion holes (22, 23, 222, 223) in a bottom wall of the bead-receiving cavity, wherein the contact sections (44) are receptacle members, and the posts (54, 55) extend into the receptacle members.

2. An electrical connector as claimed in claim 1, wherein the electrical contacts have guiding sections (45) for guiding the posts (54, 55) into the receptacle members.

3. An electrical connector as claimed in claim 1, wherein the electrical contacts (251, 242, have guiding sections (245), the posts (254, 255) are disposed in the guiding sections to align the contact sections with the pin-insertion holes.

4. An electrical connector as claimed in claim 1, wherein a partition (14, 214) is located in the bead receiving cavity (12, 212) so that contact-receiving cavities **(13*a*, 13*b*, 213*a*, 213*b*) are formed between the partition and the ferrite bead (30, 230) in which the contact sections (44, 244)** are disposed.

5. An electrical connector as claimed in claim 1, wherein an extension (16, 216) extends outwardly from said insulation housing (10, 210), said extension including grooves (17, 217) along which wire-connecting sections (43, 243) of the electrical contacts (41, 42, 241, 242) extend along with electrical wires (71, 72, 271, 272) connected thereto.

6. An electrical connector as claimed in claim 1, wherein pressure-applying members (56, 57, 252, 253) are located on said cover member (50, 250) for engagement with an upper end of the ferrite bead to urge the ferrite bead against the bottom wall of the bead-receiving cavity.

7. An electrical connector as claimed in claim 5, wherein projections (262) are located on the cover member (250), and lugs (249) are located on the electrical contacts (241, 242) that engage with said projections when the cover member (250) is mounted on the insulating housing (210) to prevent the electrical contacts from being pulled out of the housing when a force is applied to the electrical wires (271, 272).

8. An electrical connector as claimed in claim 1, wherein a retaining latch (15, 215) is provided by said insulating housing (10, 210) engaging an upper end of the ferrite bead (30, 230) thereby retaining the ferrite bead in the bead-receiving cavity (122, 212).

9. An electrical connector as claimed in claim 1, wherein latch members (19, 21, 58, 61, 219, 216, 258, 261) are provided on the insulating housing (10, 210) and the cover member (50, 250) for latching the cover member onto the insulating housing.

* * * * *